United States Patent [19]

Jakowicki

[11] 4,249,273

[45] Feb. 10, 1981

[54] TILE CONSTRUCTION FOR A SWIMMING POOL

[76] Inventor: Henry Jakowicki, 123 Malts AVe., West Islip, N.Y. 11795

[21] Appl. No.: 859,253

[22] Filed: Dec. 9, 1977

Related U.S. Application Data

[63] Continuation-in-part of Ser. No. 839,039, Oct. 3, 1977, which is a continuation-in-part of Ser. No. 734,328, Oct. 20, 1976, Pat. No. 4,051,562.

[51] Int. Cl.[2] ..... E04H 3/16; E04H 3/18

[52] U.S. Cl. ..... 4/494; 52/309.11; 52/169.7; 4/493; 4/509

[58] Field of Search ..... 4/172, 172.11, 172.15, 4/172.18, 172.17, 172.19, 172.21, 191, 190, 192, 2, 3, 4; 52/309, 309 DT

[56] References Cited

U.S. PATENT DOCUMENTS

| | | | |
|---|---|---|---|
| 1,454,310 | 5/1923 | Booraam | 4/172.18 |
| 1,461,026 | 7/1923 | Booraam | 4/172.18 |
| 1,797,397 | 3/1931 | Booraam et al. | 4/172.18 |
| 2,645,783 | 7/1953 | Allen | 4/191 |
| 3,611,451 | 10/1971 | Armstrong | 4/2 X |
| 3,821,818 | 7/1974 | Alosi | 4/191 |
| 3,839,748 | 10/1974 | Stillman, Jr. | 4/172.21 |

*Primary Examiner*—Henry K. Artis

*Attorney, Agent, or Firm*—Posnack, Roberts, Cohen & Spiecens

[57] ABSTRACT

Tile construction for a swimming pool comprising an elongated tubular member having a longitudinal channel therein which can be filled with insulation material. The tubular member can have further separate channels with a plurality of orifices extending into the further channels and opening externally of the member. The orifices provide communication between the further channels and the exterior of the tubular member. The tubular member has a flat outer surface and the orifices open in the vicinity of the flat outer surface. A plurality of tubular members can be used to form the wall or bottom of the pool or a deck for the pool. The tubular member can have flanges with additional channels therein isolated from the other channels and which may or may not be provided with orifices for fluid flow. The tubular member can be constructed from a transparent resin material and the additional channels can have a liquid crystal coating for changing color with temperature change.

11 Claims, 33 Drawing Figures

FINA
AAU

TILE CONSTRUCTION FOR A SWIMMING POOL

CROSS-RELATED APPLICATION

This application is a continuation-in-part of Ser. No. 839,039 filed Oct. 3, 1977 which in turn is a continuation-in-part of Ser. No. 734,328 filed Oct. 20, 1976 and now issued as U.S. Pat. No. 4,051,562.

FIELD OF THE INVENTION

The invention relates to tile construction for a swimming pool comprising a tile tube which can serve as a marker, as a means for the circulation and storage of water in the pool and outside the pool (pool deck), as an air or gas bubbler, as a lining for the walls and bottom of the pool and as a heat insulator.

BACKGROUND

In conventional swimming pools there is generally effected a circulation of water through filters with return of water to the pool via suitable inlets. These inlets can be wall inlets or bottom inlets. For best performance, the water is introduced through bottom inlets and it overflows at the top of the pool into a trench so as to be recirculated back to the inlets via filters and pumps.

It is necessary to use many spaced inlets which require the digging of a multitude of trenches beneath the pool and the placement of pipes in the trenches. A number of fittings are required between the pipes and the inlets and conventionally, these take the form of T's and L's etc. The concrete floor is then poured and a header or headers from the main supply line are joined to the pipes and thereby to the inlets. This involves a great deal of manual labor and frequently is found to have many problems. Thus, if the concrete should break, the lines themselves will also break and leakage will be consequently obtained. It is difficult to locate such leakage and also it is difficult to dig out the concrete and repair the same in sections.

In competition pools where racing takes place, it is necessary to provide racing lanes for the swimmers. These lanes are either defined by the use of ceramic tiles or the lanes are painted directly on the bottom of the pool as bottom markers, and on the walls as wall targets. Other suitable markers are safety lines, and for use in water polo and other games.

It is known to employ a coping which receives overflow water from the pool and which feeds the overflow water into a trench therebelow. An example of such construction is shown in U.S. Pat. No. 3,585,656 to Costello. In the construction in this patent the coping is composed of a plurality of horizontal elongated members connected together and forming spaces between which overflow water flows directly into the underlying trench.

In heated swimming pools, particularly enclosed indoor pools, the pool water is continuously maintained at a temperature between 75° and 85° F. There is a great loss of heat through the shell of the pool to the ground and through the surrounding building walls to the ambient atmosphere. In order to prevent great losses and consequent greater maintenance economy, the swimming pool shells, pool decks and pool enclosures are insulated. Currently it is known to inhibit heat loss in the following respects:

(a) building (pool enclosures)—in all but the southernmost climates heavy insulated walls (R20) and roofs (R30) are considered necessary and employed as a standard. Indeed some electrical utility companies will not supply electrical power for heating purposes when the insulated walls and roofs have "R" values less than those indicated above. Insulation is deemed essential to minimize the cost of fuel in heated pools.

(b) swimming pool shell and pool decks—the pools are generally insulated at present by using insulated concrete which requires the use of greater thicknesses for the same strength of ordinary concrete or by using the same thickness with greater amounts of reinforcing steel. In either case, the cost of construction is increased, sometimes to an undesirable level. A further known method is to insulate the pool shells by providing insulation under the concrete.

In the case of the use of insulation under the decks, this involves problems due to moisture penetration which reduces the insulation properties of the material.

Another method is to provide a granular underbase for the bottom sidewall and decks of the pool as a filling material. However, the insulating value of the materials is distinctly limited.

SUMMARY OF THE INVENTION

An object of the invention is to provide a tile construction in the form of a tile tube which can serve as a means for providing heat insulation for the pool and can provide water circulation in the pool.

A further object of the invention is to provide such tile construction which is relatively inexpensive and provides good distribution and diffusion of inlet water into the pool and is readily adaptable for providing heat insulation.

The tile construction can be placed at the bottom and sides of the pool and in the surrounding deck.

In accordance with the invention, it is contemplated that the tile construction comprises an elongated member having a longitudinal channel therein, said member having an outer surface adapted for constituting part of the surface of the pool, and insulation means in said longitudinal channel for inhibiting heat loss from the pool.

The tile tube preferably has a plurality of longitudinal channels arranged in transversely spaced parallel relation to one another.

The tile tubes can be arrayed in parallel or perpendicular lines at the bottom of the pool and selected tubes can form required marking lanes. The tile tubes can also be employed on the walls and they can cover the entire bottom or walls of the pool. Additionally, the tile tube can serve to form a deck system for an overflow coping construction.

The tile tube can also be employed for water circulation in the pool in which case the tile member is provided with a second longitudinal channel juxtaposed with respect to the first channel and isolated therefrom, said memger being provided with a plurality of orifices extending into the second channel and opening externally of the member to provide communication between said second channel and the exterior member to provide a flow path for water. The orifices are open in the vicinity of the outer surface of the tile tube.

Each tile tube can have two rows of longitudinal channels, the upper row being the water circulation channels while the lower row contains the insulation.

The tile tube can also be constructed with channels in the flanges which can be selectively isolated from the pool or connected therewith means of orifices in the flange. In this way, air or liquid can be discharged from these channels into the pool. The closed channels will provide increased acoustical and thermal insulation properties for the tile tube. Furthermore, by circulating different colored liquid in the channels, it is possible to change the color of the pool water or to provide different pool markings as desired.

According to a further feature of the invention, the channels in the flanges can be provided with a liquid crystal coating in order to furnish color changes in response to temperature changes in the pool.

BRIEF DESCRIPTION OF THE DRAWINGS

FIG. 7A is a diagrammatic sectional view of a modification in FIG. 7;

DETAILED DESCRIPTION

The invention will be described hereafter in relation to specific embodiments of the invention. It is to be appreciated, however, that the invention is not so narrowly restricted and can be employed in a variety of other ways which will become apparent to those skilled in the art.

Figures 1, 2, 3, 4:
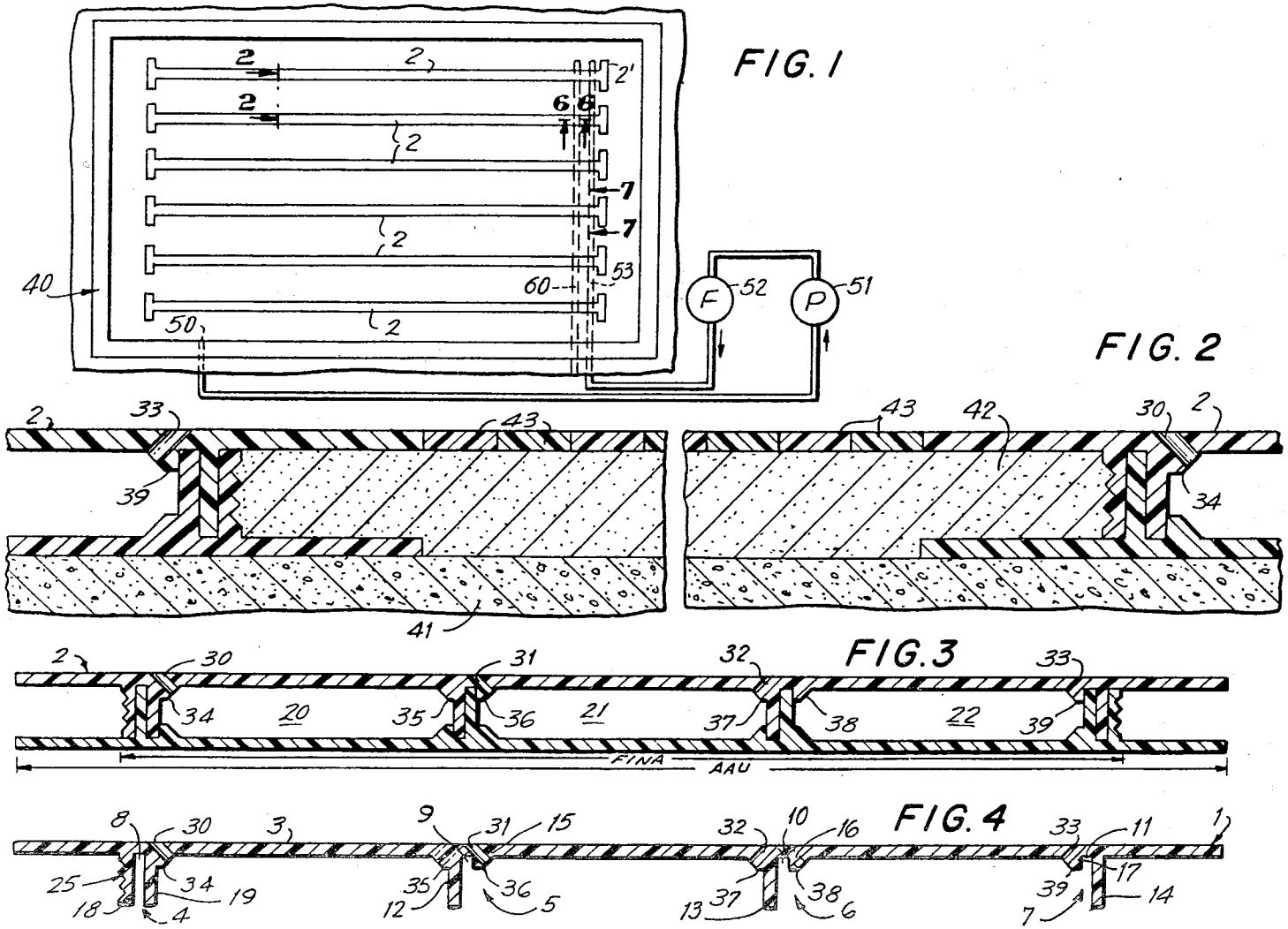
FIG. 1 is a diagrammatic plan view of a pool employing tile tubes according to the invention.
FIG. 2 is a sectional view taken on line 2—2 in FIG. 1.
FIG. 3 is a sectional view on a larger scale of one tiletube of FIG. 2.
FIG. 4 shows one of the sections of the tile tube.

In a first embodiment, the invention is constituted by a tile element 1 of the form as shown in FIG. 4 for constituting a tubular tile member or tile tube 2 as shown in FIG. 3. The tile tube is employed in the embodiment of FIG. 1 both as an element for circulation of water in a pool and also as racing lanes at the bottom of the pool.

The tile element 1 of FIG. 4 is an extruded member which comprises a flange 3 with pairs of depending webs inclusive of one end pair 4 and a plurality of additional spaced pairs 5, 6, 7. Each of the pairs of webs defines respective slots 8, 9, 10, 11. Each of the web pairs 5, 6 and 7 and comprises a respective longer web member 12, 13, 14 and a respective shorter web member 15, 16, 17. The web pair 4 includes web members 18 and 19 of substantially equal length.

As is evident from FIG. 3 when two identical sections are brought into confronting juxtaposed relation, the depending web of one section interengages into a corresponding slot of the other section to form the assembled tile tube. Such assembled tube includes, in the illustrated embodiment, three longitudinal channels 20, 21, 22.

The ends webs 18 have outer surfaces 25 of saw-tooth shape for a purpose which will be explained later. For the present, however, it is to be noted that the tile tube in FIG. 3 has as its lateral edge surfaces the saw-tooth faces of opposite tile elements. The width of flange 3 conforms to the width established by the AAU and the distance between the saw-tooth faces of end webs 18 conform to the width of the racing lanes established by FINA. Thus in the case where the tile tube is to be used for a pool satisfying FINA standards, the portion of flange 3 overhanging the web 18 is severed from the rest of the flange. The description hereafter will proceed on the assumption of AAU standards although the use according to FINA standards will be obvious to those skilled in the art.

The extruded elements are constituted of a synthetic plastic resin material, such as, polyvinylchloride or CPVC, and in order to form the tile tube as shown in FIG. 3 it is only necessary to apply a suitable solvent adhesive to the web portions of the sections to be joined.

Either before assembly of the tile tube or after such assembly, one of the tile elements 1 is drilled with a series of holes 30, 31, 32 and 33. These holes extend longitudinally along the length of the tile tube and are disposed at suitable spaced intervals for effective distribution of water into the pool in a manner to be explained more fully thereafter. Instead of holes, there can be provided slots, adjustable orifices or combinations of any thereof disposed in any direction and at any angle. For the present, however, it is to be noted that the line of holes 31 and 32 in the two intermediate web pairs 5 and 6 extend alternately in opposite directions at inclinations of 30°–45° with respect to the horizontal. The line of holes 30 and 33 at the ends of the tile tube are all arrayed with the same inclination, the holes 30 and 33 being disposed in opposite directions also at 30°–45° with respect to the horizontal. It is to be noted that the webs are formed with inclined faces 34–39 at the locations where the holes are to extend through the element. In this way drilling of the holes can be facilitated prior to assembly of the elements to form the tile tube.

Figure 21:
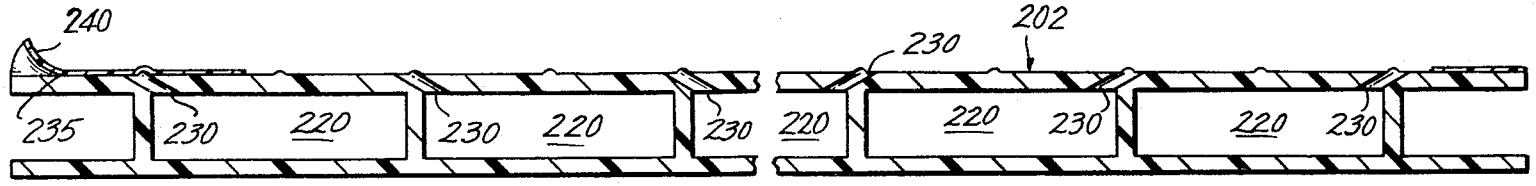
FIG. 21 is a cross-sectional view of a tile tube according to a modified embodiment.

In a modified arrangement as shown in FIG. 21, the tile tube 202 is constituted in entirety as an extruded member and can be an extrudate of any of the synthetic plastic resin materials which have been heretofore disclosed. The tile tube can gave a width determined in a manner as previously described or it can be of any suitable modular dimension. The extruded member 202 is provided with channels 220 and five such channels have been shown, although the number is variable for individual purposes. The holes are shown at 230 and are inclined in opposite directions from the center lines of the tube. The intermediate lines of holes alternate in direction along the length of the tube. This arrangements is applicable for inlets in tile tubes 202 at the bottom of the pool where such alternation will preclude the generation of water currents by breaking up the incoming jets of water. However, when the tile tube is used along a wall of the pool, as will be shown later, the holes can all be inclined downwardly to supply the inlet water in a downwards direction. All of the orifices in the tile tube of the disclosed arrangements can be precomputed for orifice spacings, orifice diameters and quantity, according to pool depths, length, point of supply, and flow in GPM.

The upper surface 235 of the tube can be sprinkled with a carborundom abrasive dust to provide a non-slip top surface finish.

A peel-off protective cover layer 240 can extend over the entire top surface of the tube to protect the top surface from scratching during installation and from clogging of the holes with mortar and the like. The peel-off cover layer can be a protective paper tape with printed matter thereon for various purposes; thus the center line of the tile tube can be printed on the paper to facilitate the assembly of the tube. Additionally, installation instructions can also be furnished on the paper layer. The layer can be transparent, if desired.

As seen in FIG. 1 a plurality of tile tubes 2 are arranged in longitudinal spaced relation along the length of a pool whose outline is diagrammatically indicated at 40. The tubes 2 can serve effectively as racing lanes at the bottom of the pool and for such purposes will be laterally spaced by a proper distance consistent with the standards established for racing pools.

Figure 13:
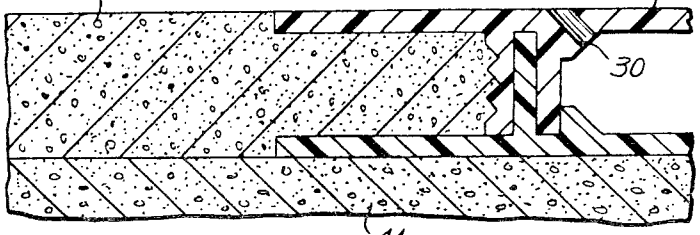
FIG. 13 is a sectional view showing a modification of a portion of FIG. 7.
Figure 12:
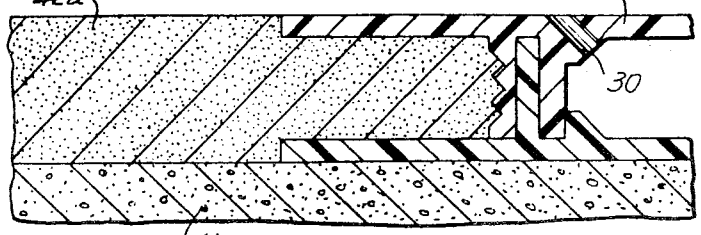
FIG. 12 is a diagrammatic plan view of a modified pool in which the tile tubes are employed for a deck.

The manner in which such a pool is fabricated will next be explained with reference to FIG. 2. Therein it can be seen that the pool 40 comprises a base 41 of concrete of the type conventionally employed in the production of pools. The pool can also be constructed of steel or vinyl. The tile tubes 2 are placed at suitable transverse spacing on the base 41 and they can be adhesively secured thereto by means of a suitable adhesive such as "plastic bond" manufactured by Preco Industries Ltd. A ground coat or scratch coat 42 is laid on the base 41 between adjacent tile tubes 2 in order to lock the tubes in place so they will form permanent lanes. As an alternative clips or other suitable means can be employed to fasten the tile tubes on the base. A combination of various of the above may be employed. After the tile tubes 2 have been secured to the base 1, a mortar is introduced between the tile tubes 2 approximately to the level of the lower surface of the upper flange thereof. As a consequence, the mortar will come into contact with the saw-tooth lateral surfaces 25 of the end webs to provide an effective locking juncture therebetween. Thereafter, conventional tiles 43 are placed on the mortar layer 42 so as to be flush with the upper surface of the tile element and thereby form a flat surface for the bottom of the pool. In a modification as shown in FIG. 12, marble dust plaster **42*a* is introduced between the tile tubes to form a flush surface with the upper surfaces of the tile tubes and the tiles 43 are omitted. In the modification shown in FIG. 13, concrete 42*b*** is introduced between the tile tubes and its upper surface is also flush with the upper surface of the tile tubes. The upper surface is either painted or left in its natural color.

Figure 5:
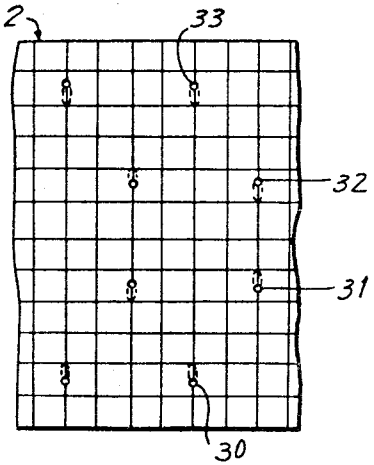
FIG. 5 is s plan view of a portion of one tile tube.

The upper surface of tile tube 2 can be formed with suitable marking means as seen in FIG. 5 or other non-slip finish so as to distinguish the same from the conventional tiles 43. Such marking means can be in a form of an embossed pattern on the surface of the tile element 2 which can be imprinted by a roller following the extrusion of the section 1. Preferably, the resinous material of the tile tube will be relatively dark, i.e., black, so as to be dinstinctly visible at the bottom of the pool to the swimmers.

The tile tubes can be formed in any length as desired and preferably the length of the tubes will be of the order of twenty feet and the tubes will be suitably joined in face-to-face relation to provide longitudinal continuity between channels 20, 21 and 22 of the adjoining tubes for pools of greater length. Referring to FIG. 11 there it is shown a longitudinal sectional view of an expansion joint between two adjacent tile tubes 2 and wherein a connection tube 45 is introduced into respective channels of the adjoining tubes 2. The connection tube 45 is made of plastic and is solvent welded to one of the tile tubes by application of a suitable solvent thereto. At the other end the connection tube 45 carries a plurality of Teflon rings 46 which serve as seals and facilitate insertion of the connection tube into the association tile tube 2. In the space between the two tubes, roughly of the order one-half an inch, there is interposed a suitable material 47 to permit expansion and contraction of the tile tubes 2. The material can be Thioseal or silicone filler.

Figure 11A:
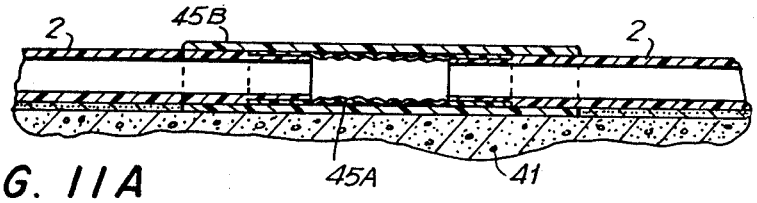
FIG. 11A is a longitudinal sectional view showing another embodiment of expansion joint.
Figure 11:
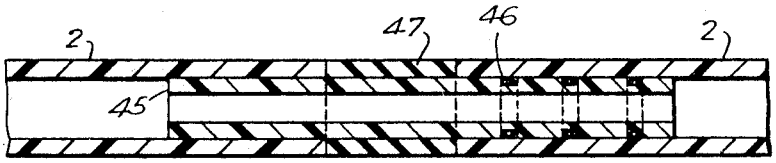
FIG. 11 is a longitudinal sectional view showing an expansion joint between two adjacent tile tubes.

Referring to FIG. 11A which shows a modified form of expansion joint connection, here it is seen that at the ends of adjoining tile tubes 2, flexible connectors 45A are adhesively secured. These connectors 45A can be made of flexible PVC. The assembly of the adjoining tubes and flexible connectors 45A is slidably contained within an expansion joint cover 45B which is affixed to the base 41 of the pool. Accordingly, if any relative longitudinal movement takes place between the tile tubes 2, this can be taken-up by the flexible connectors 45A while the tile tubes are relatively slidable within the covers 45B. The upper flange of the cover 45 B serves as a protector of the flexible connector 45A and prevents the foot of a swimmer from becoming lodged between the spaced adjoining surfaces of the tile tubes 2.

As diagrammatically illustrated in FIG. 1, an overflow is provided at the periphery at the top of the pool into which water will flow and a water inlet 50 is connected to a pump 51 which pumps the water through a filter 52 to a header 53 which is connected via respective inlets 54 with control valves 54' to individual channels of the tube tile. In this way continuous circulation of water is established in the pool. After water has been pumped through the inlets 54 into the channels 20, 21, 22 in the tile tubes, the water will traverse the channels and flow outwardly through the holes 30–33 into the pool. The alternating arrangement of the lines of holes 31 and 32 of each tile tube improves the mixing of the water into the pool while the inclination of the holes 30 and 33 at the ends of the tile tube tends to direct the water towards the laterally adjacent tile tubes.

Figure 10A:
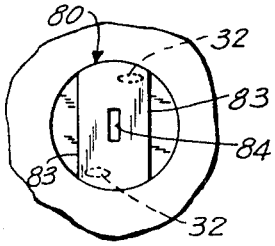
FIG. 10A-10C are diagrammatic plan views of the means shown in FIG. 9 for various degrees of adjustment.
Figure 10B:
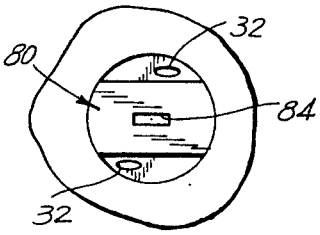
Figure 10C:
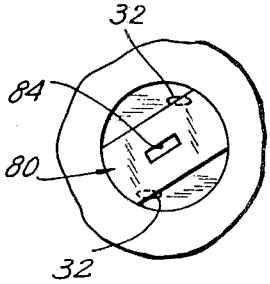

FIGS. 9 and 10A–10C show a control element 80 by which the degree of opening of the holes in the tile tubes can be regulated. The element 80 is turnably mounted in the tile tube and includes a valve 81 mounted in a recess 82 in the flange in the tile tube at a location where two holes 32 are adjacent one another. The valve 81 has parallel sides 83 and as seen in FIG. 10A the angular position of the element can be such that the outlets of holes 32 are blocked. In FIG. 10B the element 80 is turned 90° and the outlets of holes 32 are completely open. In FIG. 10C the element 80 is turned at an angle of 45° and the outlets of holes 32 are 50% open. The control element 80 is provided with a slot 84 in the surface of the valve to facilitate turning of the control element.

Figure 7:
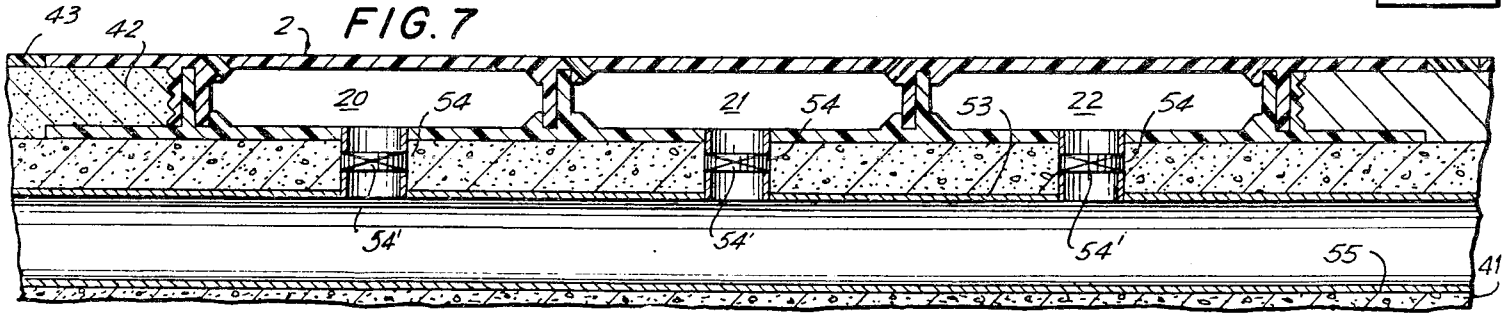
FIG. 7 is a sectional view taken on line 7—7 in FIG. 1.
Figure 9:
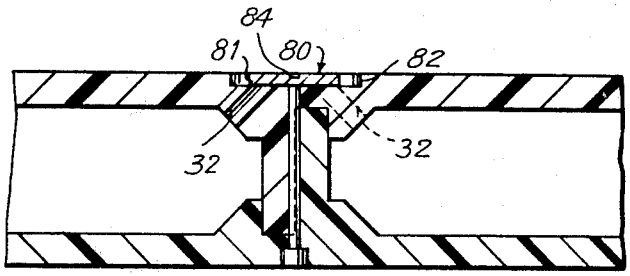
FIG. 9 is a sectional view through a portion of a tube showing means for adjusting the degree of opening of holes therein.

As evident from FIGS. 1 and 7, only a single header 53 is necessary for supply of recirculated water to all of the tile tubes 2. This obviates the need for a conventional network of a great number of pipes beneath the concrete base 41 of the pool for respective supply of water to the pool through individual inlets passing through the base of the pool as in the conventional constructions. As seen, the single header 53 is laid in a trench 55 and if it should become necessary to repair the header, this becomes a relatively simple matter since its location can be easily determined and suitable repairs made in contrast with a network of headers which are cast within the concrete base 41 as in the prior art.

Figure 6:
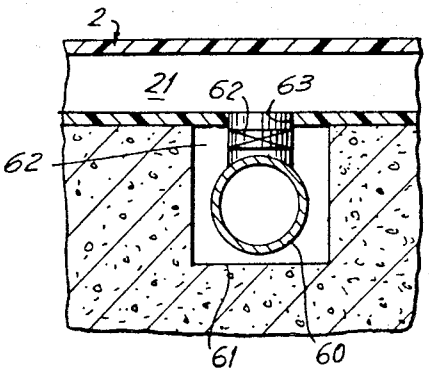
FIG. 6 is a sectional view taken on lines 6—6 in FIG. 1.

For drainage purposes to empty the pool, there can be employed a single drain pipe 60 as shown in FIGS. 1 and 6 which runs transversely in a trench 61 beneath all of the lines of tube tiles 2. The drain pipe 60 is connected by means of respective connectors 62 incorporating control valves 62' to holes 63 extending into the central longitudinal channels 21 of each tile tube for drainage purposes. It is only necessary to open a valve at the outlet of drain tube 60 to permit the pool to be drained via the central channels of the longitudinal lines of tile tubes. As an alternative, a single central drain outlet can be connected to the tile tube at the center of the pool.

According to a modification, the drain can be employed for recirculation purposes in which case the drain is disposed at one end of the pool and the inlet header at the opposite end of the pool. The drain can be connected to the inlet of the pump in this way approximately 10% of the water from the pool can be continuously in circulation.

Instead of forming a tile tube 2 from two interconnected elements 1 as shown in FIGS. 2 and 7, a single tile element 1 can be employed as shown in FIG. 7A and placed on base 41 and sealably locked in place by scratch coat 42 whereby longitudinal channels will be formed communicating with header 53 via inlets 54.

Although the invention has been described hereinabove with regard to the use of the tile tubes for racing lanes, it is to be understood that when there are no racing lanes, the tile tubes can be disposed around the perimeter of the pool as wall or bottom inlets or other markings solely for the purpose of effective circulation of water in the pool.

Each of the lines of tile tube is provided at its extremities with a crosswise T arrangement of a tile tube in the manner as shown at 2' in FIG. 1 in accordance with FINA, AAU, NCAA, CNCA and other codes.

In lieu of an individual drain pipe 60 and individual connectors 62, a grating can be placed and filled between tile tubes 2 at the top of trench 61 and the drain holes 63 in the central longitudinal channels 21 of the tile tubes can lead directly into the trench 61. The outlet of the drain can be valved in any suitable manner and, for example, by means of a displaceable valve plate or the like.

It is also contemplated that the tile tubes can be employed with coping around the edge of the pool to collect water from a deck of the pool namely, through the holes 30–33 for drainage via longitudinal channels 20–22. This will be described in greater detail later.

Figure 8:
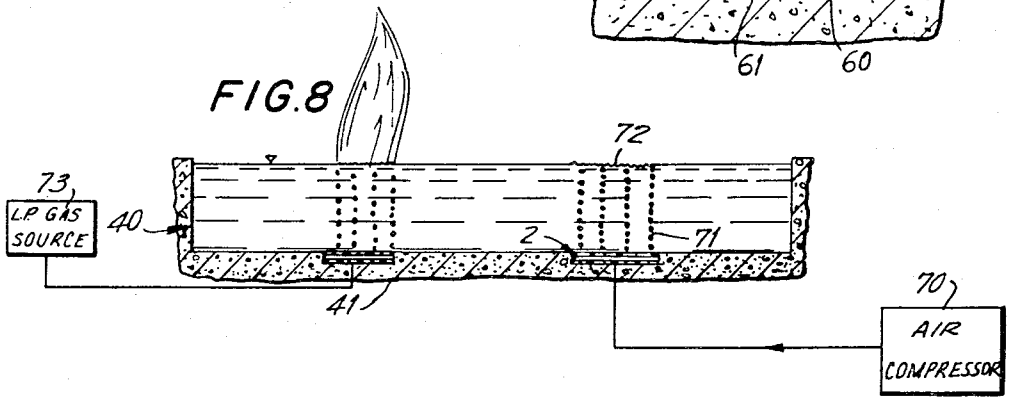
FIG. 8 is a diagrammatic longitudinal sectional view showing the tile tube used as an air and as a gas bubbler.

According to further uses of the tile tube of the invention, reference is made to FIG. 8 wherein one tile tube is shown diagrammatically connected to an air compressor 70. Such tile tube is intended to distribute bubbles of air into the pool as shown at 71 via the holes 30–33, in order to produce a ripple effect 72 at the surface of the water. This is undertaken to allow a diver to see the surface of the water in diving pools. Of course, such air compressor 70 will be connected to one or more tile tubes 2 under each diving board at the deep end of the pool where the diving usually takes place. Also shown in FIG. 8 is the connection of an LP gas source 73 to a tile tube 2 for introducing gas into the pool, said gas bubling through the water and being lighted at the top surface thereof for display effects, e.g. the production of a flame 74 at the surface of the pool.

The construction of the tile tube according to the invention is effective to provide better and more effective distribution of liquid, air or gas into the pool, resulting in higher diffusion efficiency. Furthermore, it is simple to control the location of the inlets since only a single line thereof is generally necessary. Indeed, even if a plurality of inlet conduits are provided, their location can be exactly determined.

It is further noted that racing lanes formed by tile tubes are generally closer than normally required for inlet distribution. As a consequence, extremely effective and uniform distribution of water can be obtained.

It should also be noted that the tile tubes can be employed on the walls of the pool as a supplement or as a wall distribution means for water or air as desired.

Figure 22:
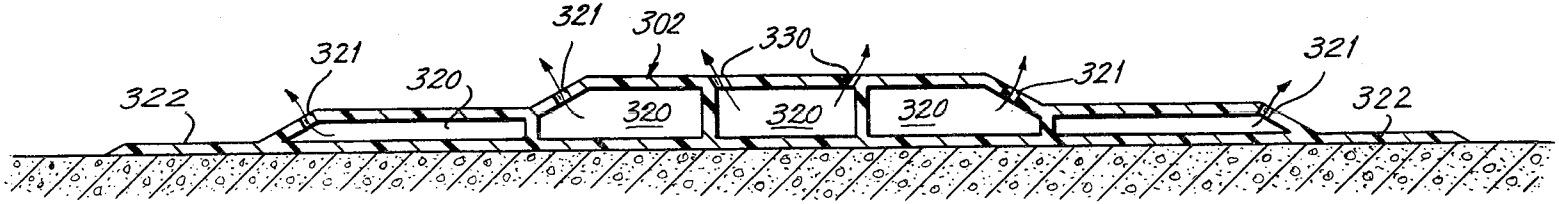
FIG. 22 is a cross-sectional view of a further modified tile tube.

In a further modification, as shown in FIG. 22, the tile tube is generally indicated at 302 and is formed as an extruded member of suitable synthetic resin thermoplastic material as before. However, in this embodiment, the tile tube is intended for subsequent application onto the bottom of an existing pool. The tile tube can be placed on the bottom by means of a suitable adhesive as explained previously. However, in this case the tile tube extends above the bottom of the pool and therefore is made relatively flat. Such tile tubes can serve as "instant" markers in existing pools and can serve for inlet water in much the same manner as a tile tube which has been incorporated in the bottom of the pool. The endmost channels 320 are reduced in height and the surfaces 321 are pitched for safety purposes. The tile tube is formed with laterally extending flap portions 322 to enlarge the area of adhesive joinder and as a universal extrusion for FINA and AAU width dimmensions. The direction of water flow from the tile tube into the pool is effected through holes 330 and is shown by the arrows in FIG. 22.

Figure 22A:
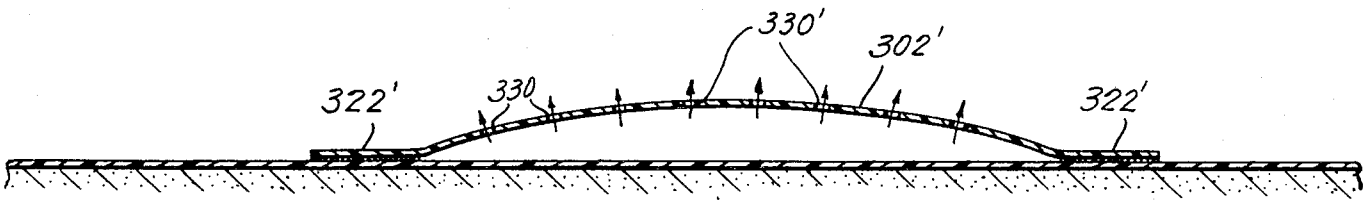
FIGS. 22A and 22B shows a modified arrangement for inflow of water into a pool having a vinyl liner.
Figure 22B:
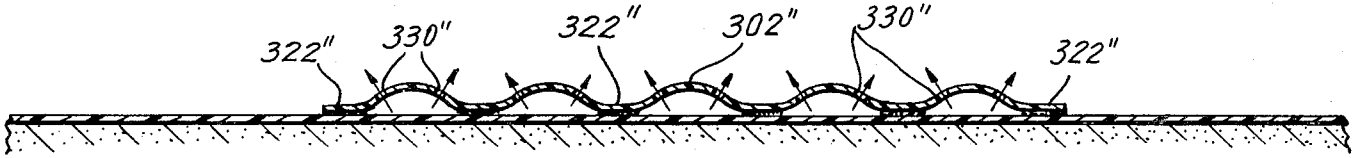

The tile tube of FIGS. 22A and 22B is made of a flexible material for the purpose to be explained hereafter.

The embodiment shown in FIGS. 22A and 22B is employed with pools having vinyl liners and in such case the tile tube 304' is in the form of a perforated vinyl or prestrip whereby the pressurization of the tile tube will have the tendency to pull the vinyl liner to remove all wrinkles and other imperfections at the pool bottom when used as bottom inlets or along the walls when used as wall inlets, or both. In this regard, as the tile tube is furnished with water under higher pressure than the water in the pool in order to discharge the water through the orifices 330' into the pool, lateral forces will be applied at flat portions 322' acting towards the center of the tile tube which will have the effect of applying tension to the vinyl liner tending to remove any wrinkles therein. The tile tube 302' in FIG. 22A can be made of suitable color to define a racing lane at the bottom of the pool. The tile tube 302" in FIG. 22B is similar to that in FIG. 22A but is formed of a ripple shape. In this arrangements the jets of water are introduced through the orifices 330" in alternately inclined directions. It is also seen that the tile tube 302" is anchored to the vinyl liner at a plurality of spaced flat portions 332".

The perforated vinly or PVC strip shown in FIGS. 22A and FIG. 22B can also be installed on the back side of the pool liner.

Figure 14:
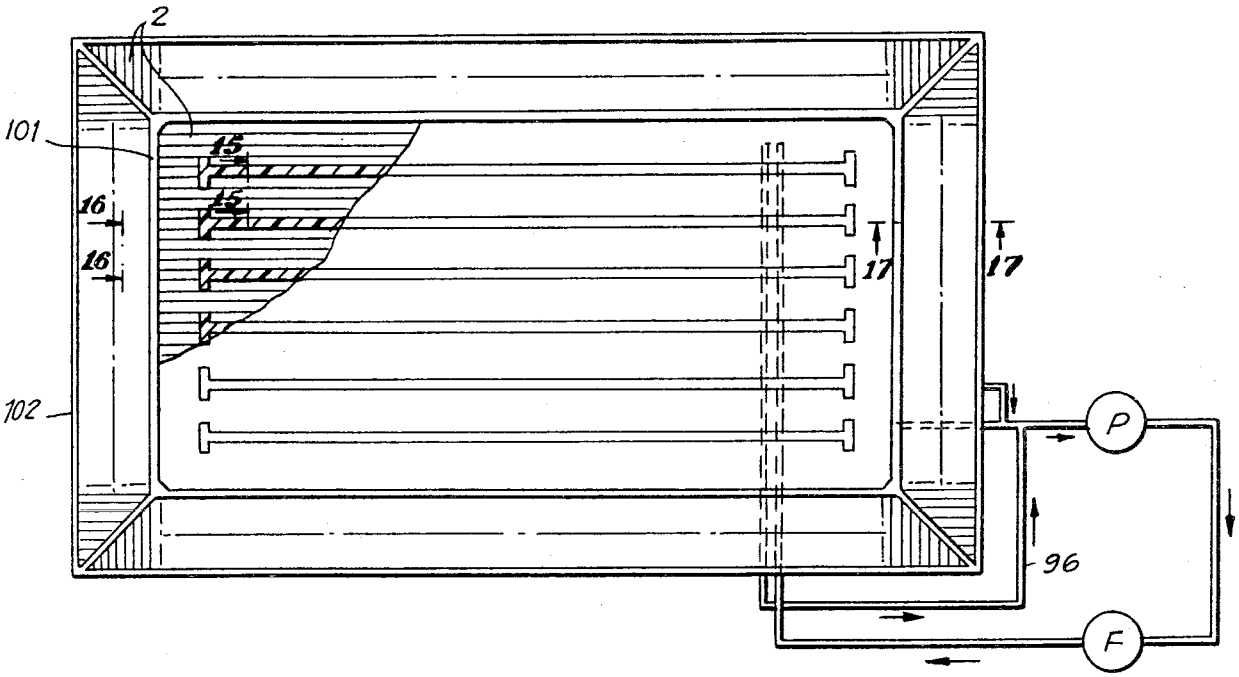
FIG. 14 is a sectional view showing another modification of a portion of FIG. 7.
Figure 15:
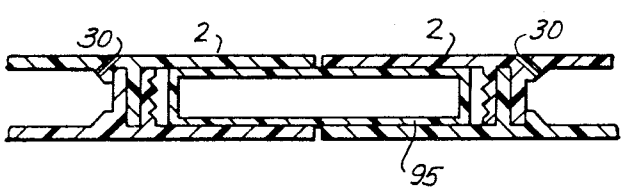
FIG. 15 is a diagrammatic sectional view taken on line 15—15 in FIG. 14.

Reference is next made to FIG. 14 which shows a diagrammatic plan view of a modified pool and therein can be seen the pool surrounded by a coping 101 and a deck 102. Furthermore, in this embodiment it will be seen that the bottom of the pool is composed in entirety by tile tubes 2 which are placed adjacent one another and suitably interconnected. Thus, with reference to FIG. 15 therein can be seen adjacent tile tubes 2 which are spaced from one another by a relatively small distance of the order of one-sixteenth of an inch and wherein a longitudinal bracing member 95 is interposed between the adjacent tile tubes and adhesively secured thereto. The circulation path for the water is shown in FIG. 14 and therein the pump P circulates water from overflow in a manner which will be explained more fully later through the filter back into the pool. In this embodiment 10% of the circulating water is removed from the pool bottom and conveyed through conduit 96 to the inlet of the pump. The hydraulic system is designed so that the water flow will provide optimum flow diffusion. The current requirements for construction of swimming pools in many jurisdictions require the presence of a gutter which will be capable of continuously removing at least 90% of the recirculated water for return to the filter. Furthermore, all such gutter pools must have a surge capacity for example, of the order of one gallon per square foot of pool area as promulgated in New York state, and also by NSPI "Minimum Standards for Public Pools", Paragraph 12.7.4. Current requirements also call for the provision of a continuous deck extending a minimum of 10'-0" completely around the pool. As seen in FIGS. 14 and 15 the deck is composed of juxtaposed tile tubes 2 which serve as a support surface and also as a perforate surface which will allow recirculation of water in the hydraulic circuit as will be explained more fully later.

Figure 16:
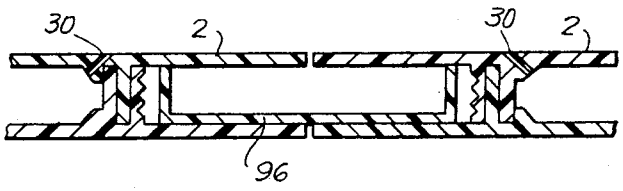
FIG. 16 is a sectional view taken on line 16—16 in FIG. 14.
Figure 17:
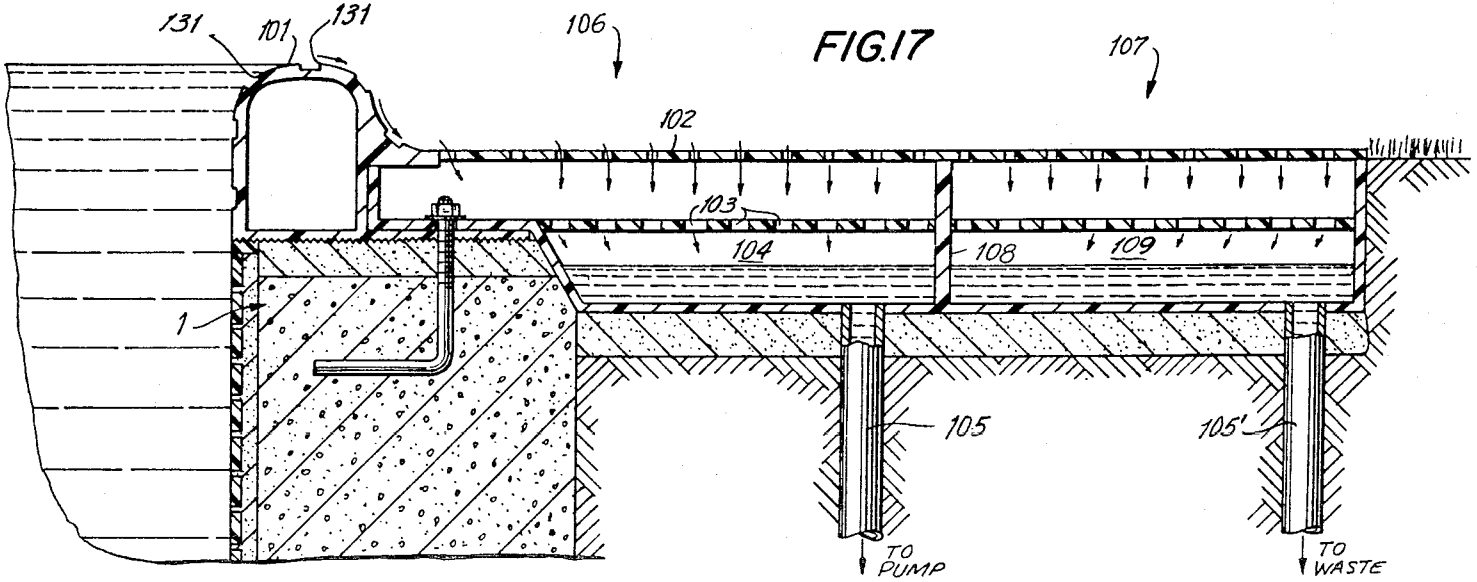
FIG. 17 is a sectional view taken on line 17—17 in FIG. 14.

FIG. 16 shows the provision of juxtaposed tile tubes 2 which are braced and supported by an open channel member 96 of thermoplastic material secured to the adjacent tile tubes. The tile tubes are spaced apart by a minimum distance of the order of one sixteenth of an inch. Referring to FIG. 17 wherein a diagrammatical sectional view is shown to illustrate the surge capacity of the construction, the coping 101 is shown mounted on the wall 1 of the pool, the coping being constituted as a hollow member made, for example, of PVC,ABS resin, or reinforced fiber glass. The level of water in the pool is higher than that of the upper edge of the coping 101 so that water continuously overflows the coping onto the deck 102. The coping is formed with notches 131 extending along the length of the coping to provide a convenient gripping surface for a swimmer coming out of the pool and for reducing the speed of flow of the water over the coping and minimizing noise. The deck is composed of the tile tubes which are perforated at their upper flange and formed with a nonslip surface by the embossing or similar treatment as previously explained. Thereby, the overflow water travels through the apertures in the upper flange of the tile tubes and flows into the longitudinal channels therein. The water flows through large apertures 103 provided in the bottom of the lower flange of the tile tubes and thence into a reservoir 104 whose outlet 105 is connected to the pump P. The deck is divided into two sections 106 and 107 separated by a partition 108 which acts to prevent commingling of water passing in sections 106 and 107. The section 106 will essentially receive overflow water from the pool whereas section 107 will receive splashed water by the bathers along with some overflow water. This mixture of the splashed water and overflow water is conveyed to a chamber 109 which has an outlet 105' leading to waste.

Figure 18:
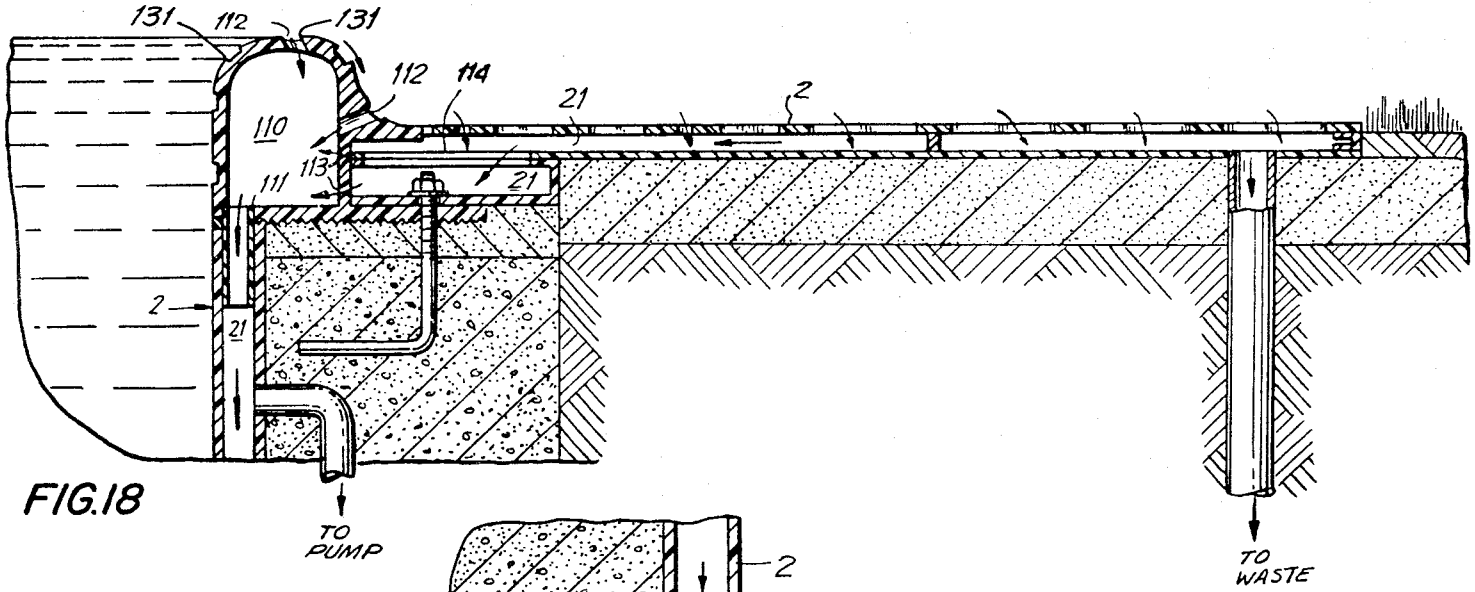
FIG. 18 shows a modification of the construction in FIG. 17.

FIG. 18 shows a modified arrangement of the construction in FIG. 17 and herein instead of a separate reservoir 104, the flow within the channels of the tile tubes is fed into the hollow interior 110 of the coping and conveyed along longitudinal channels in vertical tile tubes 2 which are laid on their ends along the side walls of the pool. As seen, the vertical tile tubes 2 are joined to a common manifold 111 which connects the channels of the tile tubes to the interior 110 of the coping. The longitudinal channels are also connected to a suitable outlet conduit as, for example, in the manner as shown in FIG. 6, said outlet conduit extending to pump P. As evident in FIG. 18 the coping is provided with apertures 112 along the periphery thereof for direct inlet of fluid therein. Near its base the coping is provided with transverse slots 113 to allow flow of liquid from the interior of the channels 20–22 of the tile tubes forming the deck into the interior 110 of the coping. As seen immediately to the right of the coping in FIG. 18, two tile tubes 2 of different lengths are superimposed on one another and these tile tubes are solvent welded along their adjoining surfaces and formed with relatively large openings 114 respectively in their lower and upper flanges which are in registry with one another and define an outlet for the overflow liquid in the upper tile tube for conveyance to the interior of the coping and thence to the pump.

Figure 19:
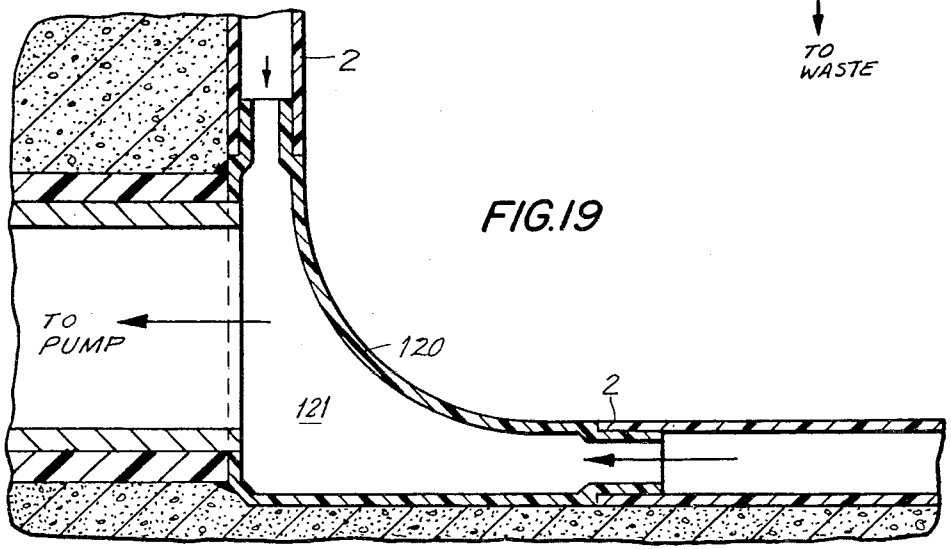
FIG. 19 is a sectional view of a modification of the bottom corner portion of the pool taken on line 17—17 in FIG. 14.

FIG. 19 shows the arrangement of FIG. 18 and wherein the tile tubes 2 at the bottom of the pool are connected to the outlet of the vertically placed tile tubes 2 at the end wall of the pool which receives the water from the interior of the coping. As seen in FIG. 19 a hollow curved member 120 is disposed at the bottom corner at the end wall and this curved member 120 defines a hollow interior 121 which communicates with the longitudinal channels in the tile tubes of the end wall and with the longitudinal channels at the bottom of the pool. The hollow interior 121 is connected to the pump inlet and thereby the overflow water will be recirculated along with water from the interior of the pool. The water which is taken from the interior of the pool can be suitably controlled by valves to represent 10% of the recirculating flow as previously explained with respect to FIG. 14.

It is to be understood that the upper surface of the tile tubes forming the deck must be perforate and non-slip, and for this purpose the surface can be either treated or embossed as previously explained. The apertures in the surface of the tile tubes can be adjustable in the manner as previously explained with respect to FIGS. 9 and 10A–10C. It is to be appreciated that in lieu of holes 30–33 elongated slots or any other form of opening with or without adjustment means can also be provided. The size of these slots and holes is such as to minimize the likelihood of penetration by toes and fingers.

Individual tile tubes in the deck or at other locations in the pool can be suitably employed as "dry" channels for electrical conduits, wires and cables for racing timing systems and underwater speakers, PA systems or the like. These tile tubes will be isolated from tile tubes through which water flows.

Figure 23:
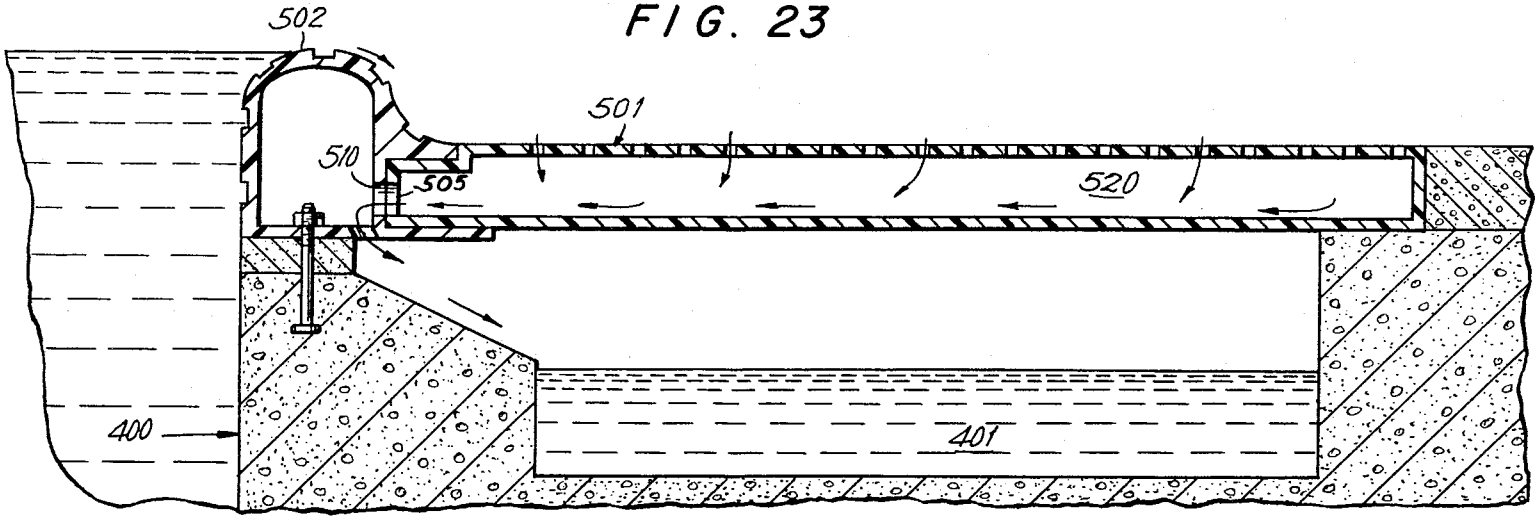
FIG. 23 is a section similar to FIG. 17 showing a modified embodiment.

Referring now to FIG. 23, herein is shown a modification of the embodiment in FIG. 17 and it is seen that the concrete wall 400 of the pool directly forms a reserve tank or trench 401. The trench can be in communication with the interior of the pool by means of a pump as previously explained.

As in FIG. 17, the deck is composed of a plurality of tiles tubes designated in FIG. 23 at 501 perforated at their upper flange and formed with a non-slip surface by the embossing or similar treatment as previously described. The over-flow water travels through the apertures in the upper flange of the tile tubes and flows into the longitudinal channels 520 therein in direction as shown by the arrows.

In the embodiment shown in FIG. 23, there are no apertures formed in the lower flange of the tile tubes and the outlet for water introduced into the tile tubes is provided at the end of the tile tube by means of a large slot or open end opening 505 at the end of the tube. The installation of tile tube 501 is made so as to pitch the bottom of the tube in a manner which will facilitate the flow of the water in the channel to the outlet 505. The water flows from the outlet of the tile tubes through an opening 510 formed in the coping 502 and thence into the trench 401.

Figure 24:
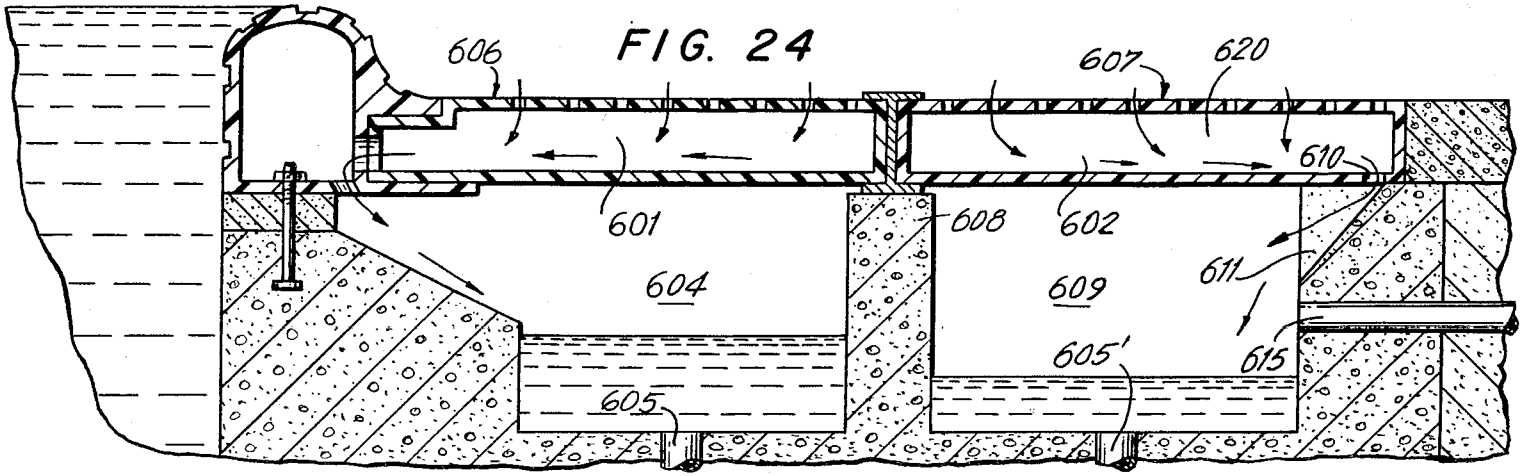
FIG. 24 is a section similar to FIG. 23 of a further modified embodiment.

In the modification shown in FIG. 24, the deck is formed with inner and outer sections 606 and 607 respectively, each formed with tile tubes of the construction as indicated in FIG. 23. The flow of water in tile tube 601 in the inner section is towards the coping and the flow of water in the tile tubes 602 in the outer section is in the opposite direction and away from the coping. The water from the inner section 606 flows into trench 604 associated therewith and this water can be conveyed through conduit 605 to pump P for recirculation into the pool. The water from the tile tubes 602 in section 607 is conveyed via opening or slot 610 in the bottom of tile tubes 602 and notch 611 in the concrete wall of the pool into trench 609 which is disposed below the tile tubes 602 in section 607. The tile tubes in sections 606 and 607 are separated from one another and supported on an interior partition 608 of the pool which serves to isolate the trenches 604 and 609 to prevent mixing of the water therein. Trench 609 is connected to outlet conduit 605' which leads to waste.

A further conduit 615 leads into trench 609 and can be connected to a heater or air conditioner for supply of conditioned air to the trench for heating or air conditioning purposes depending upon ambient conditions. The trench 609 can therefore be used to effect heating, air conditioning or ventilating of the space around the pool. The conduit 615 can alternatively be introduced into longitudinal channels 520 or 620.

Figure 20:
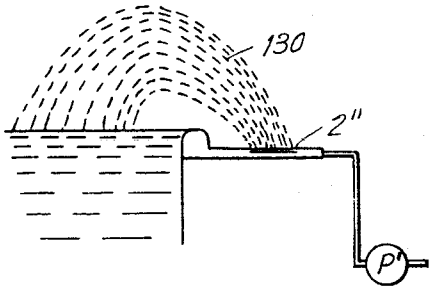
FIG. 20 is a diagrammatic illustration showing a further use of a tile tube.

Referring to FIG. 20 therein is shown another use for a selected tile tube and herein a pump P' is connected to a selected tile tube or tile tubes 2'' for pumping water therein so that the water will be discharged through the holes in the tile tube in the form of a spray 130 through which the swimmers may pass before going into the pool as desired. The spray 130 may serve as a means for filling the pool with aerated water or as a display fountain.

The use of the tile tubes as inlets or as a main drain obviously will permit substantially reduced orifice diameters as compared to a localized inlet or drain without compromise of the open free end for discharge or supply. This also will result in substantial elimination of the danger of catching fingers, toes, hair, bathing suits etc. in slots or orifices particularly in wading and diving pools as compared to the previous pool building art.

By constructing the deck of tile tubes as shown hereinabove there is substantially no water accumulation on the surface of the deck and it is virtually dry at all times. Furthermore, no other concrete deck is required above and beyond that of the deck formed by the tile tubes. Moreover, no concrete support will be necessary under the full length of the tile tube deck as it will be merely sufficient to employ a compacted granular base.

Furthermore, the top flange of the tile tubes which form the deck can be made from a porous material thereby completely eliminating the need for holes and slots in the upper flange.

Furthermore, due to the use of a thermoplastic material which is electrically insulative there is no need for electrical grounding of the pool. Moreover, the material is non-corrosive and non-staining even for salt water pools. Additionally, it should be noted that the tile tubes can have various colors and textures and be capable of providing any desired deck.

More significantly, the tile tubes will serve to store the overflow water and hence constitute the required surge capacity as set forth by the codes as previously noted.

It is further to be noted that by forming openings in the webs of adjoining longitudinal channels and by providing partitions between selected webs, any desired change in direction of flow, flow rate, pressure or velocities of the water can be obtained. As a consequence, a whole network of channels for example, for the entire pool bottom or walls can be obtained by single inlet or outlet connection.

Figure 25:
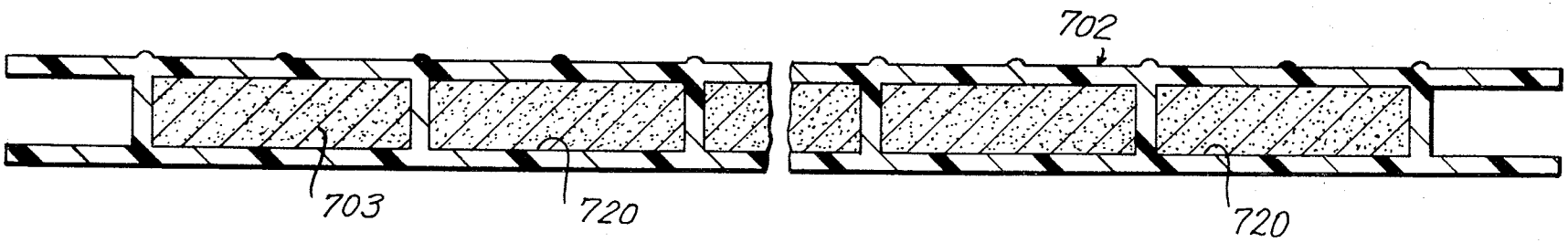
FIG. 25 is a section similar to FIG. 21 of a modified embodiment.

The tile tubes which do not participate in the feed of water to or from the pool can be employed as an insulation means. Thus, with reference to FIG. 14 not all of the tile tubes are connected to the pump P or to the drain 96 and hence many of the tile tubes of the pool bottom and deck can be utilized as temperature insulation means. Such tile tubes can be formed as previously disclosed with the exception of the holes 30-33 in the embodiment of FIG. 3 or the holes 230 in the embodiment of FIG. 21. Under such circumstances the hollow channels 20-22 in the embodiment of FIG. 3 or 220 in the embodiment of FIG. 21 serve as insulation spaces tending to prevent transfer of heat from the water in the pool or in the trenches to the surrounding environment. To promote the insulative effect, the channels in the tile tubes can contain insulative material. This is shown in FIG. 25 wherein a tile tube 702 of the type shown in FIG. 21 is shown with insulating material 703 in the longitudinal channels 720. The insulative material 703 can be a rigid type insulation, such as urethane or other expanded foam. Thereby the tile tube forms a highly insulative structural element for the pool bottom, walls and decks.

Figure 27:
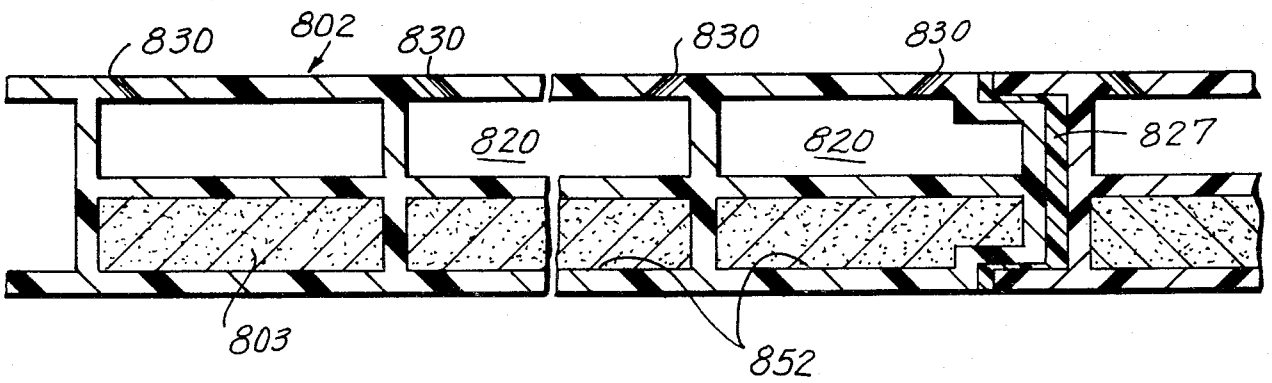
FIG. 27 is a cross-section of a modified embodiment of tile tubes as taken along lines 15—15 and 16—16 in FIG. 14.

If the tile tube is to be used for water circulation and is also to serve as an insulating element, the tile tube can be constructed as shown in FIG. 27.

Therein a two tier tile tube 802 is shown in which water circulation channels 820 are provided and insulation channels 852 are disposed beneath the water circulation channels. The water circulation channels communicate with holes 830 for circulating water into the pool in the same manner as the other disclosed water circulating tile tubes. Insulating material 803 in the form of rigid blocks fill the insulation channels 852.

The tile tubes are formed at their opposite ends with respective tongues 825 and grooves 826, and the tongue 825 of one tile tube can be engaged in the groove 826 of the adjoining tile tube and sealably joined thereto through the intermediary of a filler 827 which can be a sealant such as flexible PVC which will provide a water-tight joint while permitting expansion and contraction.

The two tier tile tube can be employed at the bottom and sides of the pool or in the deck in precisely the same manner as a single tile tube of the type shown, for example, in FIG. 3 or 21.

Figure 26:
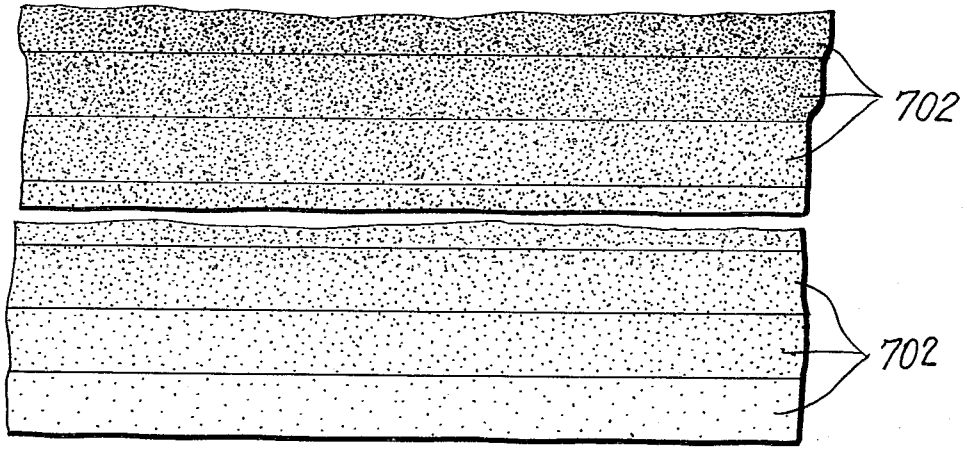
FIG. 26 is a front view of a portion of a modified wall of the pool.

In the case where the tile tubes are disposed along the wall of the pool, they can be positioned either horizontally or vertically and such tile tubes can be as shown in FIG. 26 when no recirculation is employed or as shown in FIG. 27 when recirculation is achieved at the sidewalls. As shown in FIG. 26 wherein the tile tubes are horizontal, the tile tubes can be graduated in color from top to bottom and, for example, can be dark blue at the coping to absorb solar heat and whitish blue at the bottom. In the use of the tile tubes for the deck, the darkest color can be utilized for maximum absorption of solar energy.

The tile tubes of FIG. 25 can also be used as an insulating layer for the enclosures of indoor swimming pools and the tile tubes are particularly effective since they are non-corrosive and not adversely affected by the high humidity around the pool.

Figure 28:
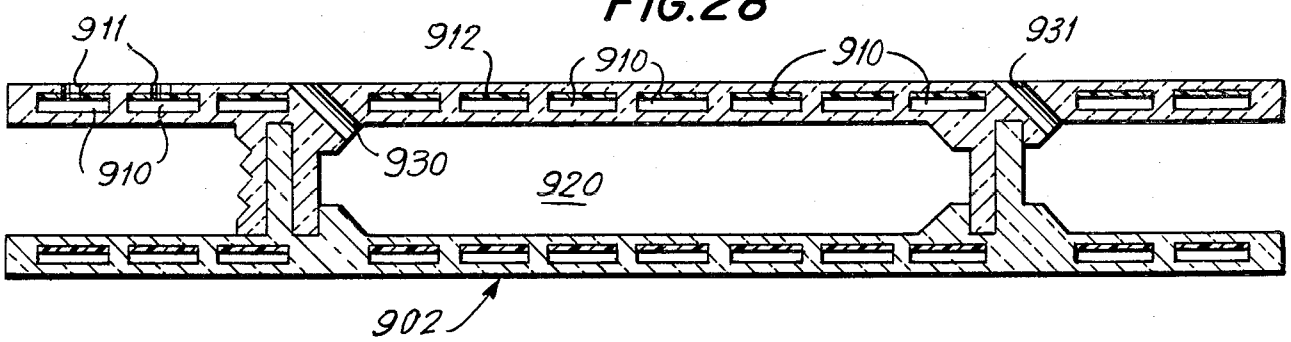
FIG. 28 is a cross-section of another modified embodiment of a tile tube.

Referring to FIG. 28 therein is shown a further embodiment of a tile tube 902 in which channels 920 serve for conveying water from the interior of the tile tube through holes 930 and 931 to the pool. The embodiment in FIG. 28 corresponds to that in FIG. 3 with the exception that the flanges of the tile tube are provided with further channels 910 which can used for HVAC, hot or cold air or liquid supply or returns. The air or liquid can be heated or cooled outside the channels and can be used to heat or cool the pool water or deck. In the case where the channels in the flanges of the tile tube are to be employed to discharge air or liquid, orifices 911 are employed as shown at the left end of the tile tube in FIG. 28. These orifices can be selectively provided for all or none of the channels 910.

By providing the channels 910 in the flanges of the tile tube, the acoustical and thermal insulative property of the tile tube is promoted particularly where the tile tubes are employed on the walls, bottom or deck of an indoor pool.

It is possible to circulate a colored liquid in channels 910 to change the color of the pool water or to provide markings for the pool in particular areas.

In a modification as shown in FIG. 28, the synthetic resin material of the tile tube can be made transparent in which case the marking of the tile tube can be varied merely by circulating different colored fluid in the channels 910 without discharge of the fluid into the pool. As further seen in FIG. 28, the channels 910 can be provided with a liquid crystal coating 912 which can change color in response to temperature and thereby also furnish a change in appearance of the tile tube. Instead of the liquid crystal coating, an electroluminescent coating can be applied in the channels 910 for undergoing change of appearance in response to electric current. In this way, the tile tubes can be altered in appearance and the walls and bottom of the pool can be changed as regards color in order to modify the pool to adapt the same, for example, for racing lanes, water polo, and the like. Additionally, the field of play for various water games such as water polo can be adjusted as desired.

Furthermore, the use of the liquid crystal coating or the electroluminescent coating can be employed to produce an illuminating effect which can minimize or eliminate the need for underwater lighting of the pool.

It is also contemplated that all or selected channels 910 in the upper flange can be placed into communication with all or selected channels in the lower flange to form a flow circuit therebetween. It is also possible in particular circumstances to provide communication between the channels 920 and the selected or all of the channels 910 in the lower and upper flanges.

It is further contemplated that the tile tubes of FIGS. 25, 27 and 28 can be used at least in part in the construction of the walls of an enclosure for an indoor or partly enclosed pool.

In the case of the use of the tile tube 702 of FIG. 25, these tile tubes will serve as self-contained structural elements which are non-corrosive and hence not subject to humidity damage in the area around the pool. Some of the channels 720 can be left empty if thermal insulation is not critical. Also the empty channels can be connected to the outside via orifices such as at 230 in FIG. 21 and hot or cold air can be supplied to the empty channels 720 for discharge to the ambient atmosphere for purposes of heating, cooling, dehumidification or the like. The tile tubes of FIG. 27 can serve as structural units in which hot or cold air can be supplied to channels 820 for discharge to the ambient atmosphere while preserving intact thermal insulation at 803.

When the tile tube 902 of FIG. 28 is employed as a wall element, it can be used to change the color or illumination effect of the wall.

Although the invention has been described with reference to specific embodiments thereof, it will become obvious to those skilled in the art that numerous modifications and variations can be made without departing from the scope and spirit of the invention as defined in the attached claims.

What is claimed is:

1. Tile construction for a swimming pool comprising an elongated member having a main longitudinal channel therein, said member being provided with a plurality of orifices extending into said channel and opening externally of the member to provide communication between the channel and the exterior of the member to provide a flow path for a fluid, said member having an outer surface adapted for constituting part of the surface of the pool, said orifices being open in the vicinity of said outer surface, said member having a flange bounding said main channel with a plurality of further channels therein, said further channels extending longitudinally parallel to said main channel and being wholly confined within said flange for fluid flow independently of the fluid in said main channel.

2. A tile construction as claimed in claim 1 wherein said flange is provided with further orifices in the vicinity of said outer surface communicating with said further channels for flow of fluid from the further channels externally of the member.

3. A tile construction as claimed in claim 1 wherein said member is transparent and said further channels include means for changing color.

4. A tile construction as claimed in claim 3 wherein said means for changing color comprises a liquid crystal coating.

5. A tile construction as claimed in claim 1 wherein said member is transparent and said further channels include means for producing illumination in said channels in the flanges.

6. A tile construction for a pool as claimed in claim 5 wherein the illumination means comprises a coating of changeable color in said channel.

7. Swimming pool construction comprising a swimming pool, and an enclosure for said pool, said enclosure including an elongated member having a longitudinal channel therein, said member having an outer surface and solid insulation means at least in part filling said longitudinal channel for inhibiting heat loss from the pool via said outer surface, said elongated member having a plurality of longitudinal channels, at least one of which is empty for flow of gaseous fluid therein, said elongated member having orifices extending from said empty channel to said outer surface.

8. A tile construction for a pool as claimed in claim 7 wherein said elongated memer has a flange with a plurality of further longitudinal channels therein for fluid flow independently of the gaseous fluid in the empty longitudinal channel.

9. A tile construction as claimed in claim 8 wherein said member is transparent and said further channels include means for changing color.

10. A tile construction as claimed in claim 8 wherein said member is transparent and said further channels include means for producing illumination in said channels in the flanges.

11. Swimming pool construction comprising a swimming pool, and an enclosure for said pool, said enclosure including an elongated member having a longitudinal channel therein, said member having an outer surface and solid insulation means at least in part filling said longitudinal channel for inhibiting heat loss from the pool via said outer surface, said elongated member having a second longitudinal channel therein juxtaposed with respect to the first channel and isolated therefrom, said member being provided with a plurality of orifices extending into the second channel and opening externally of the member to provide communication between said second channel and the exterior of the member to provide a flow path for a fluid, said orifices being open in the vicinity of said outer surface.

* * * * *